US007784964B2

(12) United States Patent
Yen

(10) Patent No.: US 7,784,964 B2
(45) Date of Patent: Aug. 31, 2010

(54) CONVERTIBLE LIGHT DEVICE

(76) Inventor: Jen Yen Yen, No. 22-2, Lane 3, Haugin Road, Nansin Tsuen, Puyen Hsiang, Changhua Hsien 51648 (TW)

( * ) Notice: Subject to any disclaimer, the term of this patent is extended or adjusted under 35 U.S.C. 154(b) by 203 days.

(21) Appl. No.: 12/284,856

(22) Filed: Sep. 25, 2008

(65) Prior Publication Data

US 2010/0073922 A1 Mar. 25, 2010

(51) Int. Cl.
*F21L 4/00* (2006.01)

(52) U.S. Cl. ..... 362/188; 362/192; 362/297

(58) Field of Classification Search ..... 362/192, 362/193, 205, 297, 185, 186
See application file for complete search history.

(56) References Cited

U.S. PATENT DOCUMENTS 2,375,886 A * 5/1945 Baker et al. ..... 431/107
5,192,126 A * 3/1993 Remeyer et al. ..... 362/184
6,394,630 B1 * 5/2002 Skidmore et al. ..... 362/394
6,550,932 B2 * 4/2003 Poon ..... 362/188

* cited by examiner

*Primary Examiner*—John A Ward
(74) *Attorney, Agent, or Firm*—Charles E. Baxley

(57) ABSTRACT

A light device includes a reflector disposed in a housing, a frame attached to an upper portion of the housing and having an axle extended into a notch of the frame, and having one or more projections extended from the axle, a carrier includes a protrusion rotatably secured to the frame with the axle and includes a number of depressions for engaging with the projection of the axle and for anchoring the carrier to the frame at selected angular positions, and the carrier includes a curved opening for rotatably attaching a spherical casing, a circuit board is disposed in the casing and includes a light member, the casing and the light member are rotatable relative to the housing and the frame and the carrier.

10 Claims, 7 Drawing Sheets

CONVERTIBLE LIGHT DEVICE

BACKGROUND OF THE INVENTION

1. Field of the Invention

The present invention relates to a convertible light device, and more particularly to a light device including a convertible or changeable structure for selectively converting to and acting as a flashlight, a night lamp device, a desk lamp or the like and for allowing the user to easily use or operate the light device.

2. Description of the Prior Art

Typical light devices comprise a head portion pivotally attached to a body portion with a pivot axis, and a light bulb contained in the head portion and operatable or actuatable to generate flashlights.

For example, U.S. Pat. No. 4,459,646 to Drane discloses one of the typical flashlight constructions also comprising a light bulb contained in a pivotal head portion for generating flashlights.

However, the light bulb is stably contained in the head portion and may not be rotated relative to the head portion and may not be converted between a flashlight, a night lamp device, a desk lamp or the other light devices.

U.S. Pat. No. 4,892,278 to Huang, U.S. Pat. No. 4,985,661 to Lin, and U.S. Pat. No. 5,170,975 to Chadwick disclose three further typical light devices each comprising a light bulb contained in a lamp shade and attached to a pivotal support for generating flashlights.

However, similarly, the light bulb is stably contained in the lamp shade and may not be rotated relative to the lamp shade and may not be converted between a flashlight, a night lamp device, a desk lamp or the other light devices.

U.S. Pat. No. 6,690,141 to Yu discloses a still further typical light device comprising a hand actuatable generator or charger for being operated manually to energize a light bulb and to generate flashlights.

However, similarly, the light bulb is stably contained in the casing and may not be rotated relative to the casing and may not be converted between a flashlight, a night lamp device, a desk lamp or the other light devices.

The present invention has arisen to mitigate and/or obviate the afore-described disadvantages of the conventional flashlights or light devices.

SUMMARY OF THE INVENTION

The primary objective of the present invention is to provide a light device including a changeable structure for selectively converting to or acting as a flashlight, a night lamp device, a desk lamp or the like and for allowing the user to easily use or operate the light device.

In accordance with one aspect of the invention, there is provided a light device comprising a housing including an upper portion and a lower portion, and including a chamber formed therein, a first reflector disposed in the chamber of the housing and disposed in the lower portion of the housing, a frame attached to the upper portion of the housing and including an opening formed therein, and including a notch formed in the frame and communicating with the opening of the frame, and including an axle extended into the notch of the frame, and including at least one projection extended from the axle, a carrier including a protrusion extended outwardly therefrom and engaged into the notch of the frame, and including an orifice formed in the protrusion for receiving the axle and for rotatably securing the carrier to the frame with the axle, the carrier including a number of depressions formed in the protrusion and communicating with the orifice of the protrusion for engaging with the projection of the axle and for anchoring and positioning the carrier to the frame at selected angular positions, and the carrier including a curved opening formed therein, a spherical casing engaged in the curved opening of the carrier and rotatably attached to the carrier with a shaft for allowing the casing to be rotated relative to the carrier with the shaft, and including a compartment formed in the casing, a second reflector disposed in the casing, a circuit board disposed in the compartment of the casing and including a light member attached to the circuit board and engaged into the second reflector, and a switch coupled to the light member for controlling the light member.

The casing includes a bracket disposed in the compartment of the casing, and the second reflector is engaged in the bracket. The shaft includes a hole formed therein, the light member is electrically coupled to the switch with an electric cable which is engaged through the hole of the shaft.

The carrier includes an aperture formed therein and communicating with the curved opening of the carrier for engaging with the shaft and for rotatably attaching the casing to the carrier. The carrier includes a lower cover attached thereto for rotatably securing the casing to the carrier.

A supporting base is further provided and includes a socket opening formed in an upper portion for engaging with the lower portion of the housing. The supporting base includes a hand actuatable generator disposed in the supporting base, and the hand actuatable generator includes a hand actuatable motor disposed in the supporting base, a chargeable battery disposed in the supporting base and coupled to the hand actuatable motor for being charged by the hand actuatable motor, and a hand actuatable lever coupled to the hand actuatable motor for operating the hand actuatable motor to generate an electric energy and to charge the chargeable battery.

A circuit board is further provided and disposed in the supporting base, and the switch is attached to the circuit board and coupled to the light member, and a switch button is attached to the switch. The supporting base includes a compartment formed in the bottom portion of the supporting base for receiving the hand actuatable lever. The supporting base includes a battery disposed in the supporting base and coupled to the light member.

Further objectives and advantages of the present invention will become apparent from a careful reading of the detailed description provided hereinbelow, with appropriate reference to the accompanying drawings.

DETAILED DESCRIPTION OF THE PREFERRED EMBODIMENT

Figure 1:
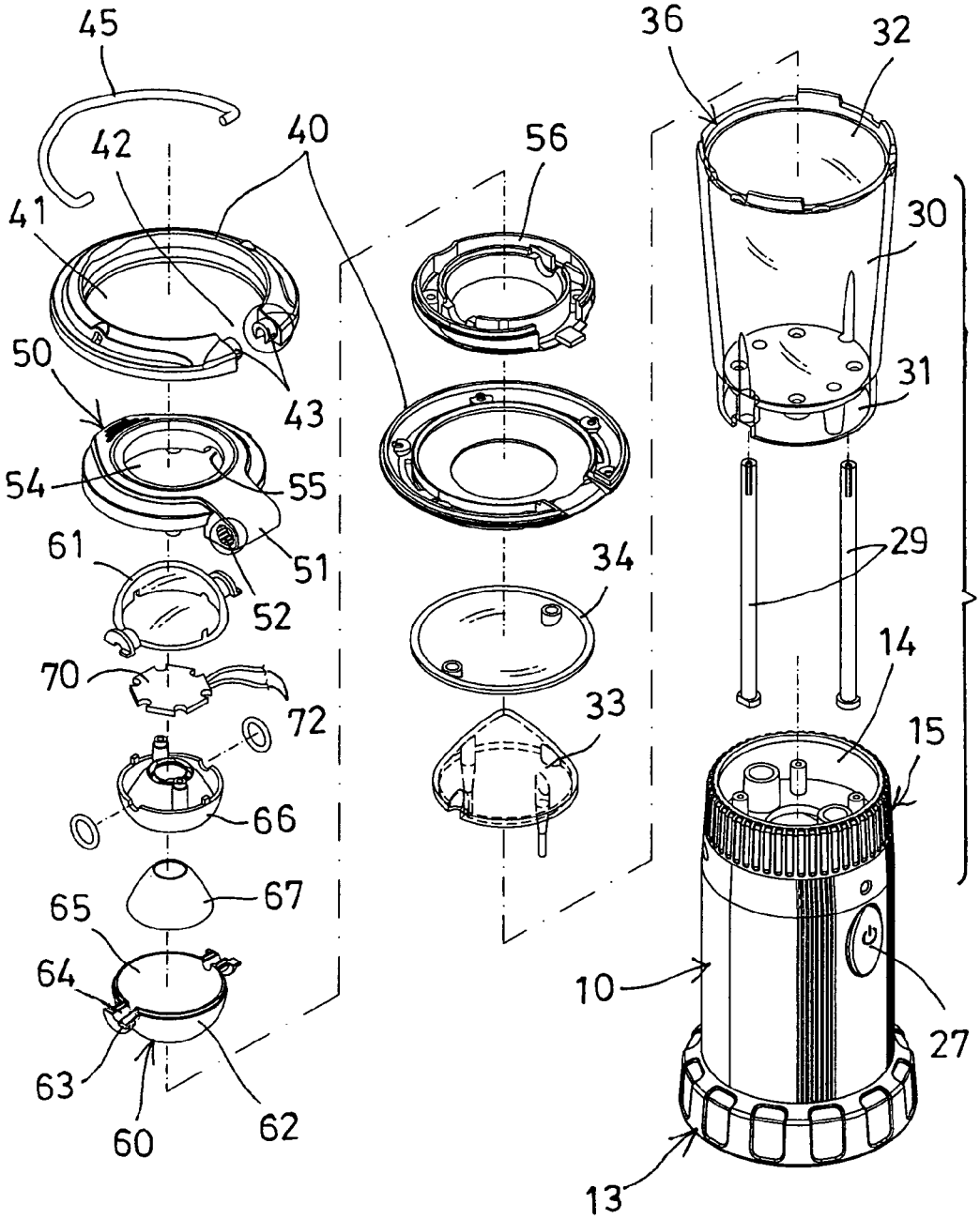
FIG. 1 is a partial exploded view of a light device in accordance with the present invention.

Referring to the drawings, and initially to FIGS. 1-4, a light device in accordance with the present invention comprises a supporting container or base 10 including a chamber 11 formed therein (FIG. 4), a hand actuatable generator 20 is attached to or disposed in the supporting base 10 and includes a gearing set or mechanism or hand actuatable motor 21 disposed in the supporting base 10, a chargeable battery 22 also disposed in the supporting base 10 and coupled to the hand actuatable motor 21 for being charged by the hand actuatable motor 21, and a hand actuatable handle or lever 23 coupled to the hand actuatable motor 21 for rotating or driving or operating the hand actuatable motor 21 to generate the electricity or the electric energy and to charge the chargeable battery 22. One example of the hand actuatable generators 20 has been disclosed in U.S. Pat. No. 6,690,141 to Yu which may be taken as a reference for the present invention.

Figure 4:
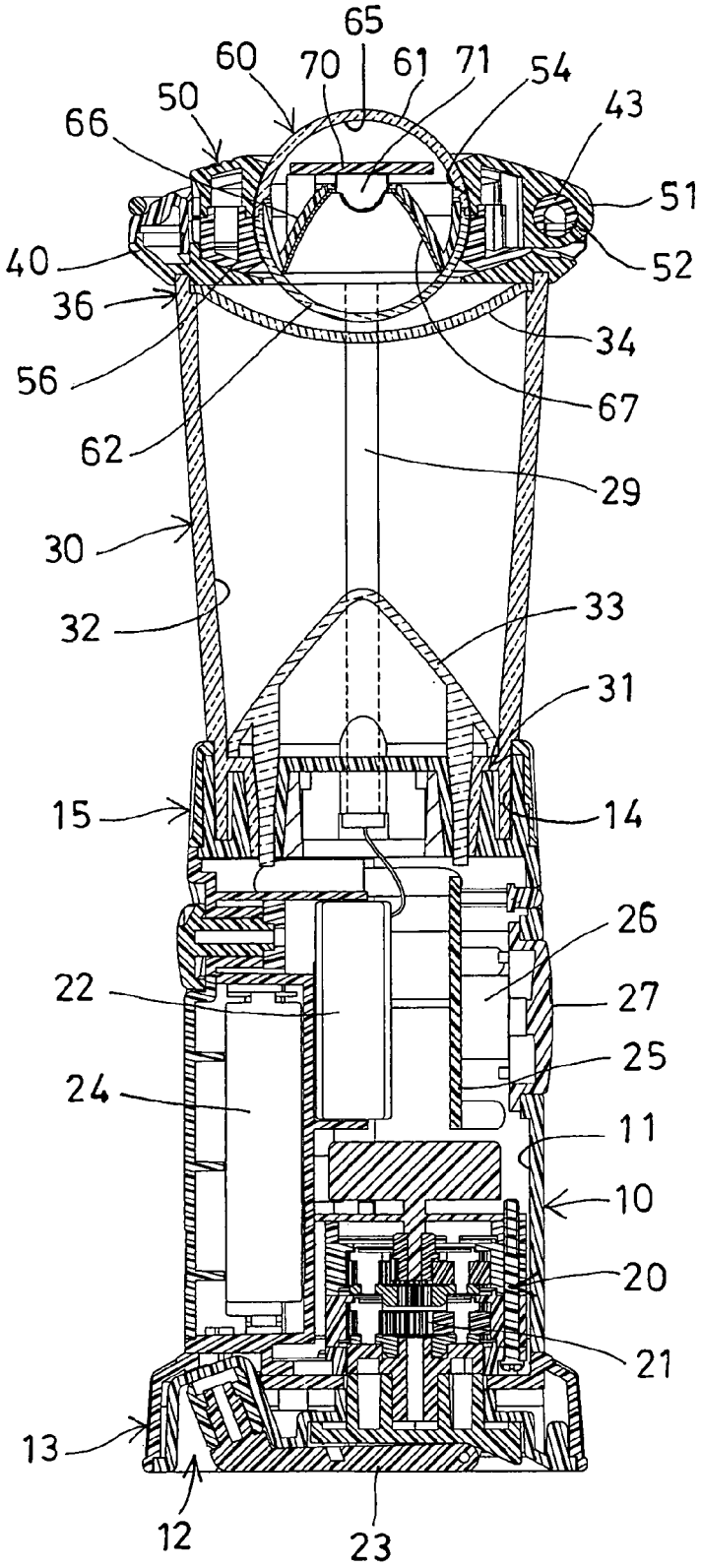
FIG. 4 is a cross sectional view of the light device taken along lines 4-4 of FIG. 3.

As also shown in FIG. 4, another or an additional battery 24 may further be provided and also disposed in the supporting base 10. An electric circuit board 25 is also disposed in the supporting base 10 and includes a switch 26 attached to or disposed on the electric circuit board 25, and a switch button 27 attached to or coupled to the switch 26 for operating or controlling the hand actuatable generators 20 and/or the battery 24. The supporting base 10 includes a compartment 12 formed in the bottom portion 13 thereof for receiving or storing the handle or lever 23 and for allowing the handle or lever 23 to be pivoted or rotated out of the bottom portion 13 of the supporting base 10 and to be rotated or driven or operated by the user. The supporting base 10 further includes a socket opening 14 formed in the upper portion 15 thereof.

A housing 30 includes a lower portion 31 attached to or disposed or engaged into the socket opening 14 of the supporting base 10 and secured to the supporting base 10 with one or more (such as two) fasteners 29, and includes a chamber 32 formed therein, and includes a cone-shaped light refracting member or reflector 33 disposed in the housing 30 and secured in the lower portion 31 of the housing 30 for light refracting or reflecting purposes, and includes a shield 34 attached to or secured to the upper portion 36 of the housing 30 for closing the upper portion 36 of the housing 30 and for preventing ash or dirt from entering into the housing 30. For example, the shield 34 is secured in the upper portion 36 of the housing 30 with the fasteners 29, and the shield 34 is preferably made of transparent or semi-transparent materials for light transmitting purposes.

Figure 2:
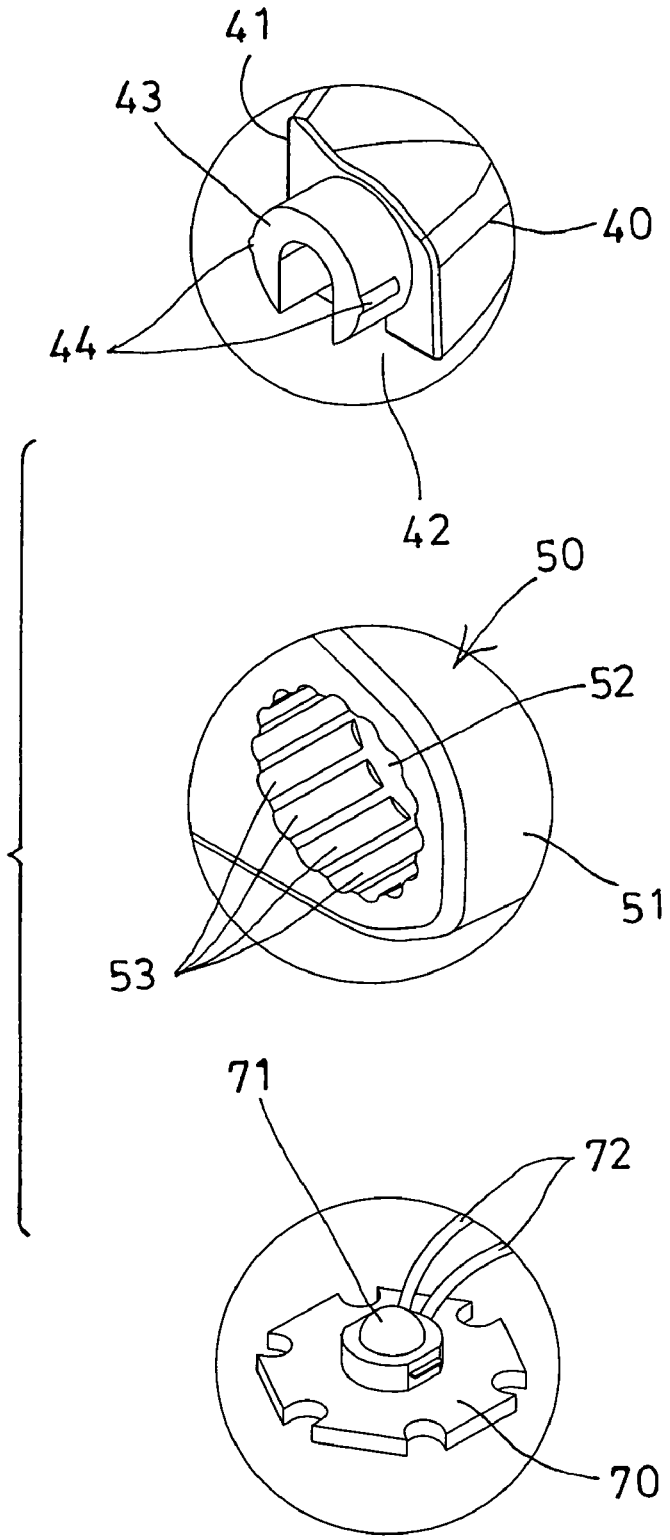
FIG. 2 is another partial exploded view of the light device.
Figure 3:
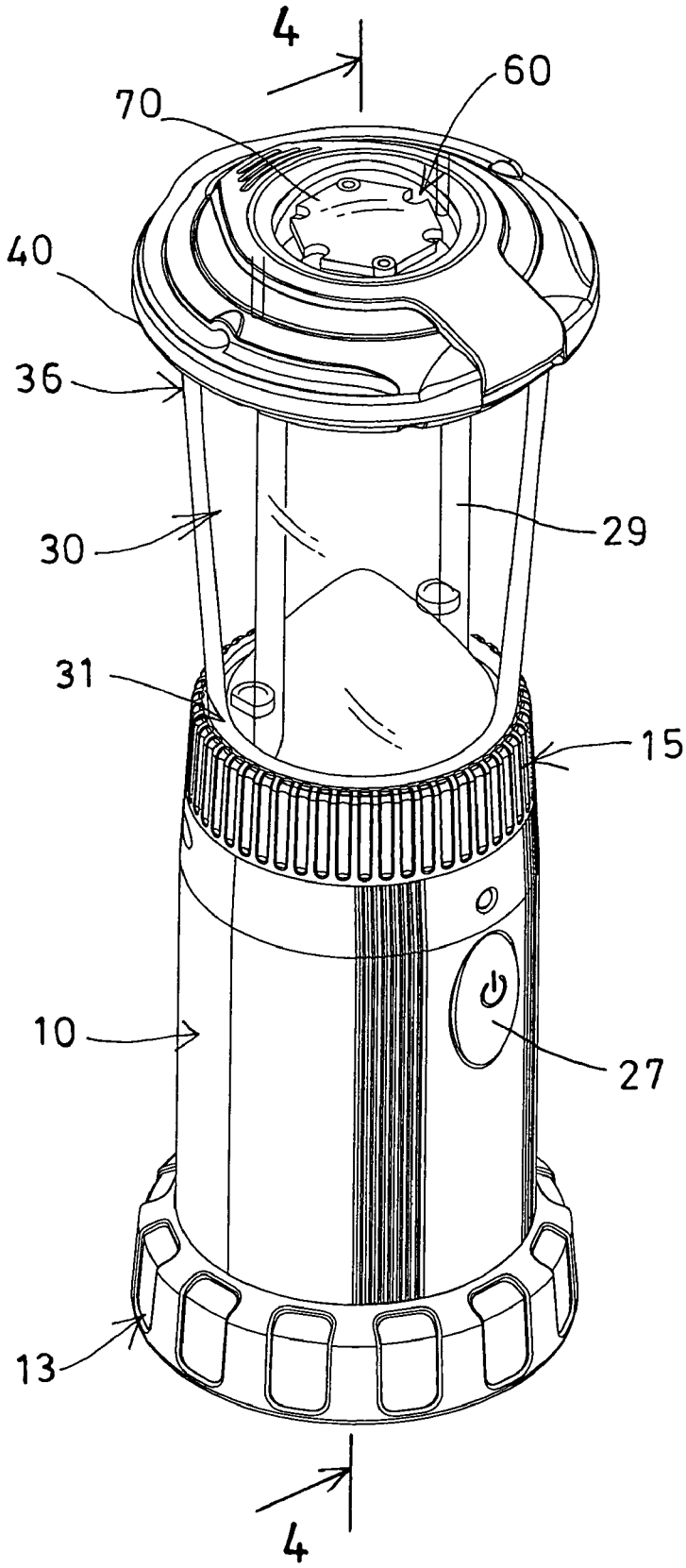
FIG. 3 is a perspective view of the light device.
Figure 8:
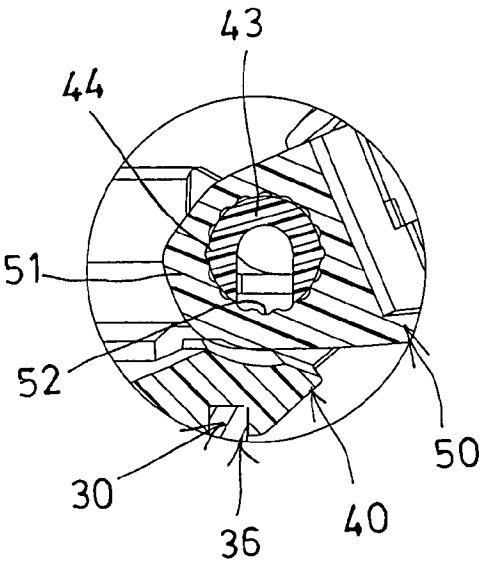
FIG. 8 is a further enlarged partial cross sectional view illustrating the operation of the light device.

A frame 40 is also attached to or secured to the upper portion 36 of the housing 30 with latches or fasteners (not shown), adhesive materials, or the like, and may include one or more (such as two) frame members 40 secured together and attached to or secured to the upper portion 36 of the housing 30, and includes a peripheral structure having an opening 41 formed therein, and includes a notch 42 formed in the frame 40 and communicating with the opening 41 of the frame 40, and includes an axle 43 (such as two axle members 43) extended into the notch 42 of the frame 40, and includes one or more (such as two) projections 44 extended outwardly from the axle 43 (FIGS. 2, 8). A hook or hand grip 45 may be attached to the frame 40 for carrying or lifting the frame 40 and the housing 30 and the supporting base 10.

A cover or head portion or carrier 50 includes a protrusion 51 extended outwardly therefrom and engaged into the notch 42 of the frame 40, and includes an orifice 52 formed in the protrusion 51 for receiving the axle 43 and for pivotally or rotatably attaching or securing the carrier 50 to the frame 40 or the upper portion 36 of the housing 30, and includes a number of depressions 53 formed in the protrusion 51 (FIG. 2) and communicating with the orifice 52 of the protrusion 51 or of the carrier 50 for engaging with the projections 44 of the axle 43 or of the frame 40 (FIG. 8) and for anchoring or positioning or securing the carrier 50 to the frame 40 or the upper portion 36 of the housing 30 at selected angular positions. The carrier 50 includes a spherical or curved opening 54 formed therein, and includes two apertures 55 oppositely formed therein (FIG. 1) and communicating with the opening 54 of the carrier 50 for pivotally or rotatably attaching a casing 60.

For example, the casing 60 includes a spherical structure for pivotally or rotatably engaging with the curved opening 54 of the carrier 50 and for pivotally or rotatably attaching the casing 60 to the carrier 50, and the casing 60 may include two casing members 61, 62 secured together, and includes one or more (such as two) studs or shafts 63 extended outwardly therefrom and pivotally or rotatably attached or engaged into the apertures 55 of the carrier 50 for further pivotally or rotatably attaching the casing 60 to the carrier 50 with the shafts 63 and for allowing the casing 60 to be rotated relative to the carrier 50 with the shafts 63. It is preferable that the shafts 63 each include a hole 64 formed therein (FIG. 1). The casing 60 includes a compartment 65 formed therein. The carrier 50 may include a lower cover 56 attached thereto for rotatably attaching or securing the casing 60 to the carrier 50.

A bracket 66 is disposed or engaged into the compartment 65 of the casing 60, and another reflector 67 is also disposed or engaged into the compartment 65 of the casing 60 and engaged in the bracket 66. Another electric circuit board 70 is also disposed or engaged into the compartment 65 of the casing 60 and attached or secured to the bracket 66, and includes a light bulb or light member 71 attached or secured to the circuit board 70 and engaged into the bracket 66 and/or the reflector 67 (FIGS. 4-7) and electrically coupled to the switch 26 and/or the batteries 22, 24 with electric wires or cables 72 which may be electrically coupled to the switch 26 and/or the batteries 22, 24 with the fasteners 29, for example, and for allowing the light member 71 to be operated or controlled with the switch 26. The electric wires or cables 72 may be engaged through the hole 64 of either of the shafts 63.

Figure 5:
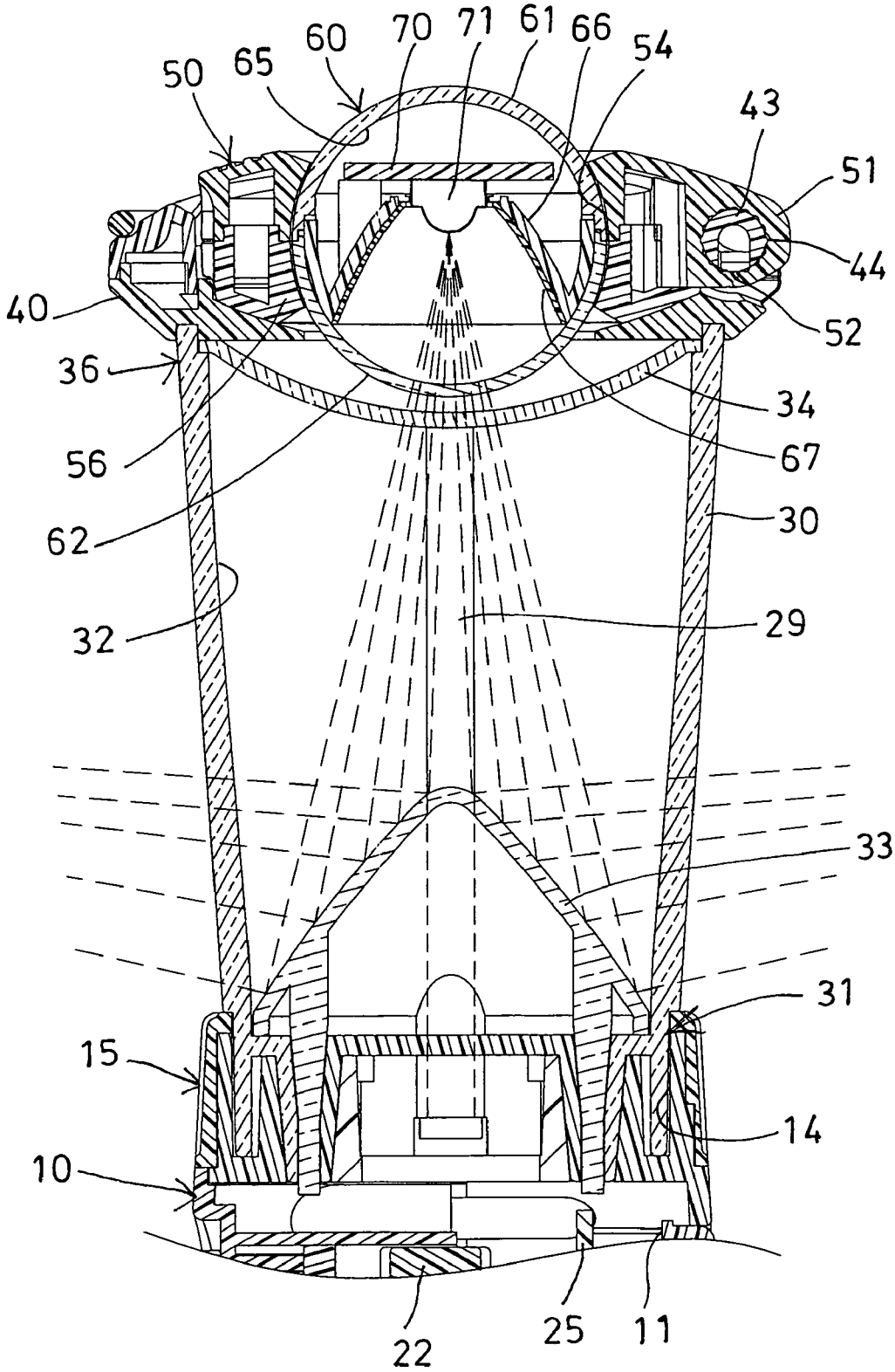
FIGS. 5, 6, 7 are enlarged partial cross sectional views illustrating the operation of the light device.
Figure 6:
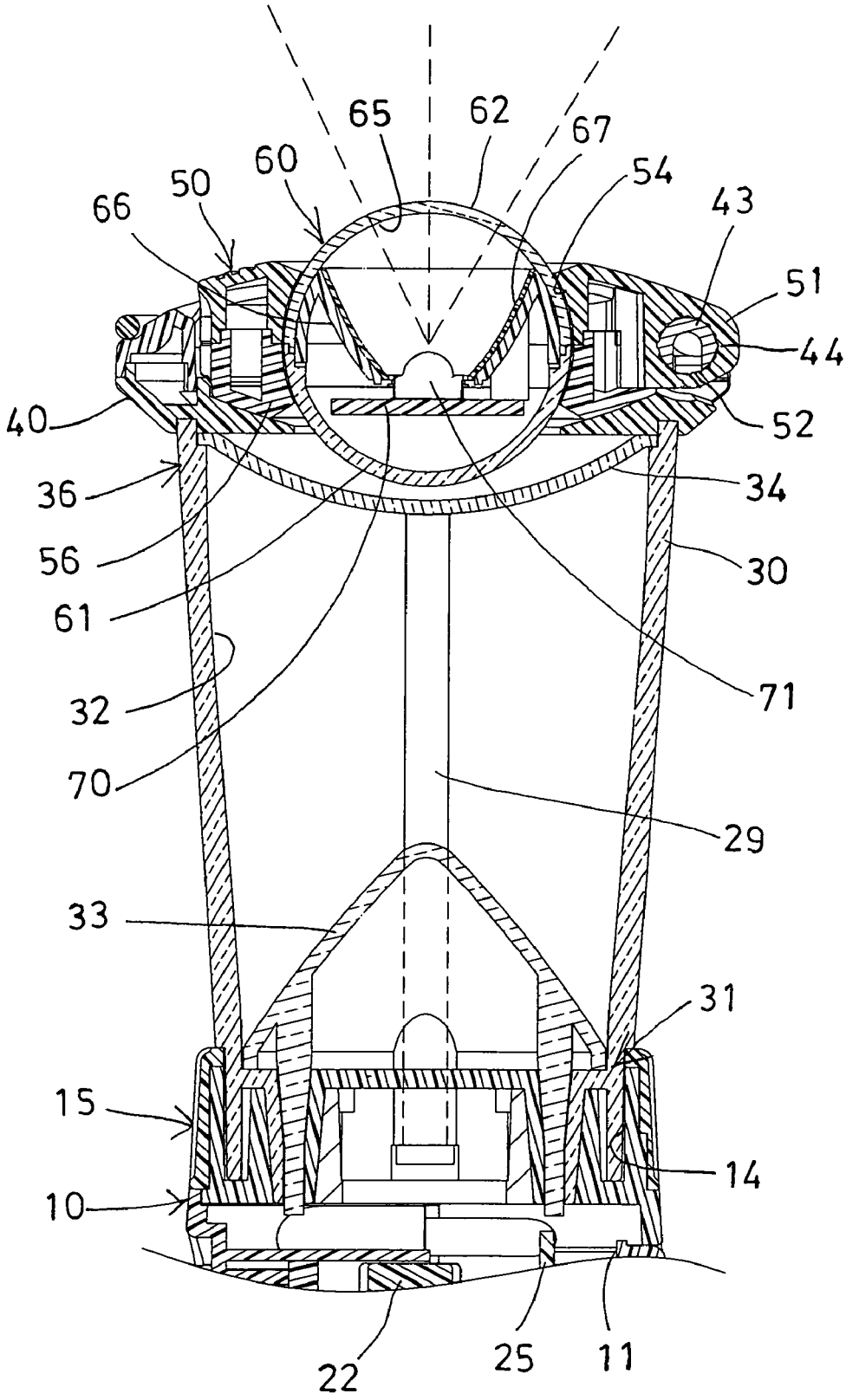
Figure 7:
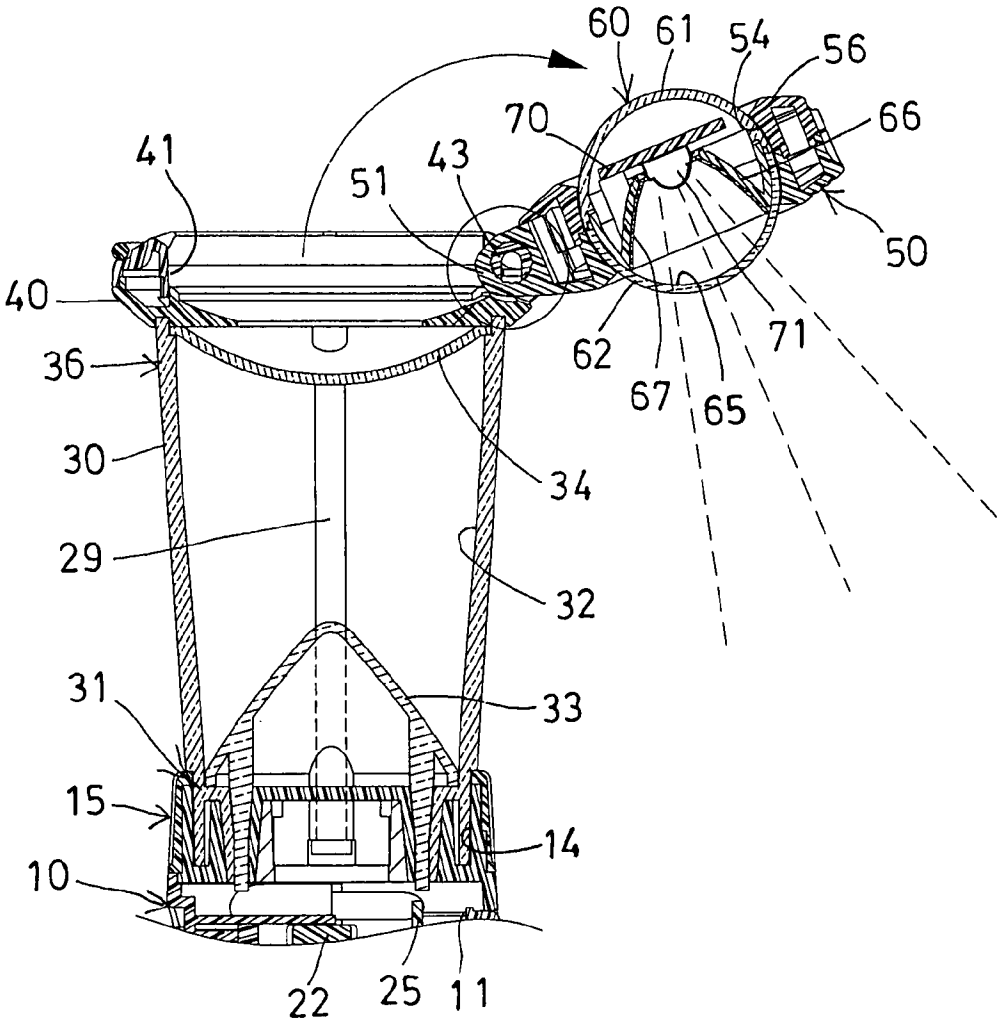

In operation, as shown in FIG. 5, the casing 60 may be rotated relative to the carrier 50 to direct the light member 71 and the reflector 67 downwardly toward the reflector 33 (FIG. 5), and the light generated by the light member 71 may shine onto the reflector 33 and may be reflected by the reflector 33 for allowing the light device in accordance with the present invention to be acted or used as a night lamp device. As shown in FIG. 6, the casing 60 may also be rotated relative to the carrier 50 to selectively direct the light member 71 and the reflector 67 upwardly or outwardly for allowing the light device in accordance with the present invention to be acted or used as a flashlight. Alternatively, as shown in FIG. 7, the carrier 50 may be rotated relative to the frame 40 or the housing 30 to direct the light member 71 and the casing 60 toward a desk top (not shown) for allowing the light device in accordance with the present invention to be acted or used as a desk lamp.

The batteries 22, 24 and/or the hand actuatable generators 20 may be used or act as an energizing means for energizing the light member 71, and may be actuated or controlled with the switch 26 and the switch button 27.

Accordingly, the light device in accordance with the present invention includes a changeable structure for selectively converting to or acting as a flashlight, a night lamp device, a desk lamp or the like and for allowing the user to easily use or operate the light device.

Although this invention has been described with a certain degree of particularity, it is to be understood that the present disclosure has been made by way of example only and that numerous changes in the detailed construction and the combination and arrangement of parts may be resorted to without departing from the spirit and scope of the invention as hereinafter claimed.

I claim:

1. A light device comprising:

a housing including an upper portion and a lower portion, and including a chamber formed therein, a first reflector disposed in said chamber of said housing and disposed in said lower portion of said housing, a frame attached to said upper portion of said housing and including an opening formed therein, and including a notch formed in said frame and communicating with said opening of said frame, and including an axle extended into said notch of said frame, and including at least one projection extended from said axle, a carrier including a protrusion extended outwardly therefrom and engaged into said notch of said frame, and including an orifice formed in said protrusion for receiving said axle and for rotatably securing said carrier to said frame with said axle, said carrier including a plurality of depressions formed in said protrusion and communicating with said orifice of said protrusion for engaging with said at least one projection of said axle and for anchoring and positioning said carrier to said frame at selected angular positions, and said carrier including a curved opening formed therein, a spherical casing engaged in said curved opening of said carrier and rotatably attached to said carrier with a shaft for allowing said casing to be rotated relative to said carrier with said shaft, and including a compartment formed in said casing, a second reflector disposed in said casing, a circuit board disposed in said compartment of said casing and including a light member attached to said circuit board and engaged into said second reflector, and a switch coupled to said light member for controlling said light member.

2. The light device as claimed in claim 1, wherein said casing includes a bracket disposed in said compartment of said casing, and said second reflector is engaged in said bracket.

3. The light device as claimed in claim 1, wherein said shaft includes a hole formed therein, said light member is electrically coupled to said switch with an electric cable which is engaged through said hole of said shaft.

4. The light device as claimed in claim 1, wherein said carrier includes an aperture formed therein and communicating with said curved opening of said carrier for engaging with said shaft and for rotatably attaching said casing to said carrier.

5. The light device as claimed in claim 1, wherein said carrier includes a lower cover attached thereto for rotatably securing said casing to said carrier.

6. The light device as claimed in claim 1, wherein a supporting base includes a socket opening formed in an upper portion for engaging with said lower portion of said housing.

7. The light device as claimed in claim 6, wherein said supporting base includes a hand actuatable generator disposed in said supporting base, and said hand actuatable generator includes a hand actuatable motor disposed in said supporting base, a chargeable battery disposed in said supporting base and coupled to said hand actuatable motor for being charged by said hand actuatable motor, and a hand actuatable lever coupled to said hand actuatable motor for operating said hand actuatable motor to generate an electric energy and to charge said chargeable battery.

8. The light device as claimed in claim 7, wherein a circuit board is disposed in said supporting base, and said switch is attached to said circuit board and coupled to said light member, and a switch button is attached to said switch.

9. The light device as claimed in claim 7, wherein said supporting base includes a compartment formed in said bottom portion of said supporting base for receiving said hand actuatable lever.

10. The light device as claimed in claim 1, wherein said supporting base includes a battery disposed in said supporting base and coupled to said light member.

* * * * *